US005772525A

United States Patent [19]

Klein

[11] Patent Number: 5,772,525

[45] **Date of Patent: *Jun. 30, 1998**

[54] GOLF PUTTER

[75] Inventor: Lon Klein, Ryebrook, N.Y.

[73] Assignee: New Vision Golf Corp., New City, N.Y.

[ * ] Notice: The term of this patent shall not extend beyond the expiration date of Pat. No. 5,569,098.

[21] Appl. No.: 825,689

[22] Filed: Apr. 2, 1997

Related U.S. Application Data

[60] Continuation of Ser. No. 733,274, Oct. 17, 1996, abandoned, which is a division of Ser. No. 356,841, Dec. 15, 1994, Pat. No. 5,569,098.

[51] Int. Cl.[6] ..... A63B 53/14

[52] U.S. Cl. ..... 473/300; 473/305; 473/316; 473/340; 473/313

[58] Field of Search ..... 473/282, 300, 473/304, 305, 316, 319, 323, 340, 292, 313

[56] References Cited

U.S. PATENT DOCUMENTS

| | | | |
|---|---|---|---|
| 1,499,128 | 6/1924 | Shroyer | 273/72 R |
| 1,573,707 | 2/1926 | Hoerle | 473/316 |
| 1,974,271 | 6/1934 | Hackett | 473/316 |
| 3,017,186 | 1/1962 | Ascardi | 273/67 R |
| 3,606,326 | 9/1971 | Sparks et al. | 273/81 R |
| 3,614,101 | 10/1971 | Hunter | 473/316 |
| 3,876,211 | 4/1975 | Caligiuri | 273/183 D |
| 4,121,832 | 10/1978 | Ebbing | 273/171 |
| 4,147,357 | 4/1979 | Strop | 273/164 |
| 4,272,077 | 6/1981 | Spivey | 273/81 R |
| 4,431,187 | 2/1984 | Rumble | 473/323 |
| 4,618,149 | 10/1986 | Maxel | 273/79 |
| 4,746,120 | 5/1988 | Mockovak | 273/81.3 |
| 4,746,124 | 5/1988 | Comitz | 273/164 |
| 4,884,808 | 12/1989 | Retzer | 273/77 A |
| 5,018,735 | 5/1991 | Meredith et al. | 473/316 |
| 5,116,054 | 5/1992 | Johnson | 273/164 |
| 5,154,425 | 10/1992 | Niskanen et al. | 273/167 J |
| 5,230,509 | 7/1993 | Chavez | 273/171 |
| 5,234,217 | 8/1993 | Johnson | 273/187.4 |
| 5,275,413 | 1/1994 | Sprague | 273/194 B |
| 5,294,118 | 3/1994 | Iwanaga | 473/316 |
| 5,308,062 | 5/1994 | Hogan | 473/316 |
| 5,308,067 | 5/1994 | Cook | 273/164.1 |
| 5,427,373 | 6/1995 | Kusumoto | 273/80 R |
| 5,547,189 | 8/1996 | Billings | 473/305 |

*Primary Examiner*—William M. Pierce
*Attorney, Agent, or Firm*—Steinberg & Raskin, P.C.

[57] ABSTRACT

A golf putter comprising a putter head and an elongated shaft having an enlarged diameter gripping end. The shaft may also include a tapered major center length portion intermediate of the grip and hosel ends. A peripheral sighting edge is provided which is structured and arranged to appear when in use tangential to a peripheral edge of the golf ball when the ball is aligned with the sweet spot of the ball-striking surface. The primary longitudinal axis of the shaft passes through the center of the golf ball when the ball is situated contiguous with the ball-striking surface and aligned with the sweet spot.

15 Claims, 7 Drawing Sheets

GOLF PUTTER

This is a continuation of U.S. application Ser. No. 08/733,274 filed Oct. 17, 1996, now abandoned, which is a divisional of U.S. patent application Ser. No. 08/356,841 filed Dec. 15, 1995, now U.S. Pat. No. 5,569,098.

BACKGROUND OF THE INVENTION

This invention relates generally to golf putters and, more particularly, to improvements in golf putter shafts, heads and their cooperative interrelationship.

Putting is one of the most important aspects in the game of golf. A golfer's ultimate objective in putting is to strike the ball with the putter head aimed correctly, and with a force, such that the ball travels in the desired direction for a desired distance. A golfer strives to develop his or her putting technique to accomplish this objective repeatedly.

It is generally recognized that it is important to eliminate excessive wrist action from the putting stroke, i.e., a firm-wristed stroke which is made basically with the arms and shoulders is desired. An arm and shoulder stroke with little or no wrist action ensures that the putter face will move through a wider arc so that the face of the club is kept close to the ground and travels horizontally and travels a longer distance along the desired target line. A firm wrist will also help keep the face of the putter head square, i.e., perpendicular, to the target line. However, many golfers have a tendency when putting to jab at the ball using a short wristy movement in which the arms and shoulders are kept still and only the wrists hinge. It is generally considered more difficult to putt accurately using this technique.

It is also important when putting for the ball to be struck by the "sweet spot" of the putter head. The sweet spot is the area on the ball-striking service of the putter head which should come into contact with the ball in order to give the greatest, most reliable and straightest distance to the ball and the best "feel". The sweet spot is usually a relatively small area on the ball-striking surface surrounding the intersection of a straight line normal to the ball-striking surface which also passes through the center of percussion of the club comprising the putter head, shaft and hosel.

When the ball is struck by the sweet spot of the ball-striking surface, the putter head will generally not twist or deviate on contact from its intended orientation square to the desired direction of travel, and the putt will start off in the direction in which the ball-striking surface was aiming. However, if the ball is struck at a point of the putter head off-line from the sweet spot towards the toe of the head, the putter face tends to open and conversely, if the ball is struck off-line towards the heel of the head, the putter face tends to close. In either case, the line along which the ball was to be hit is lost.

While a reduction in wrist action and accurate positioning of the sweet spot of the putter head upon impact will improve the accuracy of the direction in which the ball travels, golfers are always striving to develop a "feel" or "putting touch", i.e., an ability to hit the ball at exactly the right speed to make the ball travel the distance required, no more, no less. A good putting touch or feel allows the golfer to respond to different textures and moisture conditions of greens as well as general geographical putting conditions, such as putting uphill, downhill, or sidehill.

A development of a putting "feel" depends to a great extent on the ability of the golfer to sense or feel the force that acts on the putter in reaction to the force imparted by the putter head to the ball when it is struck. A good reaction force sensitivity enables the golfer, by trial and error, to learn how hard to hit the ball for any given putting condition. Reaction force sensitivity in turn depends on a number of factors.

First, when the ball is struck by the sweet spot of the ball-striking surface, the magnitude of the reaction force is more easily sensed by the golfer than if the ball is struck off-center and the number of erroneous force vectors is reduced. Moreover, it follows that if the ball is not always struck by the sweet spot, it will not always be struck exactly the same distance from the sweet spot, and the amount of force imparted will vary with every stroke making it impossible for the golfer to learn to judge distance. Second, a good overall reaction force sensitivity also depends on how sensitive the golfer's hands are to "feeling" the relatively low level vibrations indicative of the reaction force. A lightly held putter generally improves hand sensitivity and improves kinesthetic feedback. Unfortunately, it is a natural tendency for many golfers to tightly grip the putter thereby reducing hand sensitivity. Third, the putter's "transmissibility" of reaction forces also affects the overall reaction force sensitivity of the putter. Most conventional putters are constructed in a manner such that the transmission of the reaction force from the putter head to the grip portion of the shaft is absorbed or dampened as it travels through the shaft and grip. For this reason, reaction force transmission of most putters is not good which in turn increases the difficulty for most golfers to develop an accurate respectable putting touch.

The construction of the putter head itself is yet another important factor that can influence putting proficiency. A putter head should accurately translate the force acting on the putter in reaction to the impact of the ball-striking surface on the ball to improve the overall reaction force sensitivity of the club. The location of the center of gravity of the putter head as well as the weight distribution of the head are also important in this regard.

SUMMARY OF THE INVENTION

Accordingly, it is an object of the present invention to provide new and improved golf putters, golf putter shafts, golf putter heads, and improvements in the cooperative interrelationship between golf putter heads, shafts, and grips, which will enable a golfer to strike the ball with the putter head aimed, and with a force, such that the ball travels in a desired direction for a desired distance.

Another object of the present invention is to provide new and improved golf putters and putter shafts that reduce excessive wrist action and promote firm-wristed putting strokes.

Still another object of the present invention is to provide new and improved golf putters, putter shafts, heads and improvements in the cooperative interrelationships between putter shafts, heads, and grips, that facilitate alignment at impact of the sweet spot of the ball-striking surface with the ball.

Yet another object of the present invention is to provide new and improved golf putters and putter shafts that improve a golfer's hand sensitivity.

A further object of the present invention is to provide new and improved golf putters, putter heads and shafts and the interrelationships between them, that provide improved transmission of the putting reaction force from the putter head to the golfer's hands through the putter shaft.

A still further object of the present invention is to provide new and improved putter heads that accurately translate the force acting on the putter in reaction to the impact of the ball-striking surface on the ball to improve the overall reaction force sensitivity of the putter to improve putting touch.

Briefly, in accordance with the present invention, these and other objects are attained by providing a golf putter with several unique features in the construction of the putter shaft, putter head, and grip, and in their interconnection, which act both alone and in combination with each other to provide the aforesaid advantages. According to one aspect of the invention, the transverse dimension of the grip end length portion of the putter shaft (the diameter in the case of the illustrated embodiment) is substantially enlarged or oversized relative to conventional putters. It has been found that such construction greatly reduces, if not eliminates entirely, excessive wrist action in the putting stroke. Moreover, it allows the putter to be reliably gripped more loosely than heretofore and therefore improves kinesthetic feedback enhancing the tactile sensitivity of the golfer's hands to feeling the reaction force acting on the club when the ball is stuck.

According to another aspect of the invention, the putter shaft includes the above-described oversized diameter (or transverse dimension) grip end length portion, a hosel end length portion having a substantially constant reduced diameter relative to the grip end but smaller in diameter than other sections, and a major center length portion intermediate of the grip and hosel end length portions having a tapered configuration characterized by a diameter which diminishes in size from the enlarged or oversized diameter of the grip end length portion to the reduced or smaller diameter of the hosel end length portion. This tapered shaft construction improves the feel of the putter and makes the putter shaft appear optically shorter than it really is which makes the golfer feel closer to the ball when putting and therefore more confident and in control especially with inherent longer length shafts.

In order to avoid the tendency of the putter head to twist when the ball is stroked, the external configuration of the putter is provided with a peripheral sighting surface region which, when aligned with a point on the periphery of the golf ball, ensures that the ball is aligned with the sweet spot of the ball-striking surface when it is struck. Moreover, in order to ensure that no lateral twist is imparted to the ball when it is struck, i.e., in order to impart only vertical rotation to the ball when it is struck, the primary longitudinal axis of the putter shaft is arranged to pass through a region of the center of the golf ball at the instant of impact.

According to still another aspect of the invention, the elongated shaft comprises a filament wound or flag wrapped tubular member made of graphite fiber impregnated in resin material. This construction enables the tubular shaft to have an extremely thin-walled construction thereby reducing the overall weight of the putter and increasing the torsional rigidity of the putter shaft. A lighter shaft also allows the weight of the putter head to be increased without losing feel, and, the thin shaft wall and tapered configuration enhance the shaft's transmissibility of the reaction force from the putter head to the golfer's hands thereby improving the overall sensitivity of the putter.

According to yet another aspect of the invention, the putter head comprises a main frame adapted to be connected to the end of the shaft, an interchangeable full face plate, an interchangeable backweight member, and means for securing the main frame between the faceplate and backweight member to interconnect the main frame, face plate and backweight member to each other to form a unitary unified assembly. By thus providing a "floating" face plate, i.e., by in effect suspending the face plate from the main frame, an improvement in the overall reaction force sensitivity or feel of the putter is achieved. The center of gravity of the putter can be positioned well to the rear of the ball-striking surface of the face plate which both improves the feel of the putter and allows the putter head to be more precisely squared at impact. The putter head is easily disassembled to exchange one face plate for another, such as to change the loft of the ball-striking surface or to exchange the backweight member with a lighter or heavier backweight member in order to adjust the position of the center of gravity of the putter and overall weight of the integral head. The backweight member has a unique configuration adapted to position the center of gravity at an extreme rearward and peripheral location for a given construction.

DESCRIPTION OF THE DRAWINGS

A more complete appreciation of the present invention and many of the attendant advantages thereof will be readily understood by reference to the following detailed description when considered in connection with the accompanying drawings illustrating a preferred embodiment of the invention and in which.

DESCRIPTION OF THE PREFERRED EMBODIMENT

Figure 1:
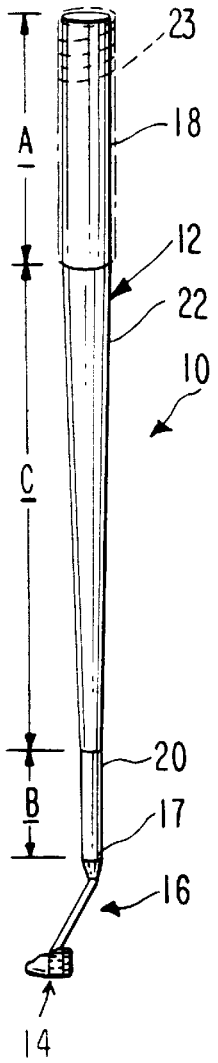
FIG. 1 is a side view of a golf putter in accordance with the present invention.
Figure 2:
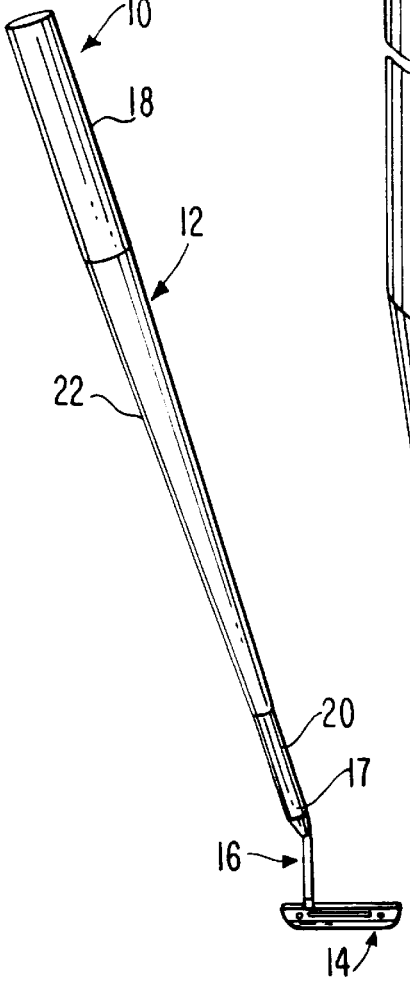
FIG. 2 is a rear view of the golf putter illustrated in FIG. 1.

Referring now to the drawings wherein like reference characters designate identical or corresponding parts throughout the several views, and more particularly to FIGS. 1 and 2, a golf putter in accordance with the present invention, generally designated 10, includes an elongated shaft 12, a putter head 14, and a hosel 16 connecting one end 17 of shaft 12 to the putter head 14. Shaft 12 includes a tubular grip end length portion 18 having a length A adjacent one end, a hosel end length portion 20 adjacent the opposite end having a length B, and a major center length portion 22 intermediate of the grip and hosel end length portions having a length C. In the preferred embodiment, A is 11 inches, B is 4.5 inches and C is 19.5 inches. A grip 23, shown in phantom in FIG. 1, is applied over grip end length portion 18.

Figure 3:
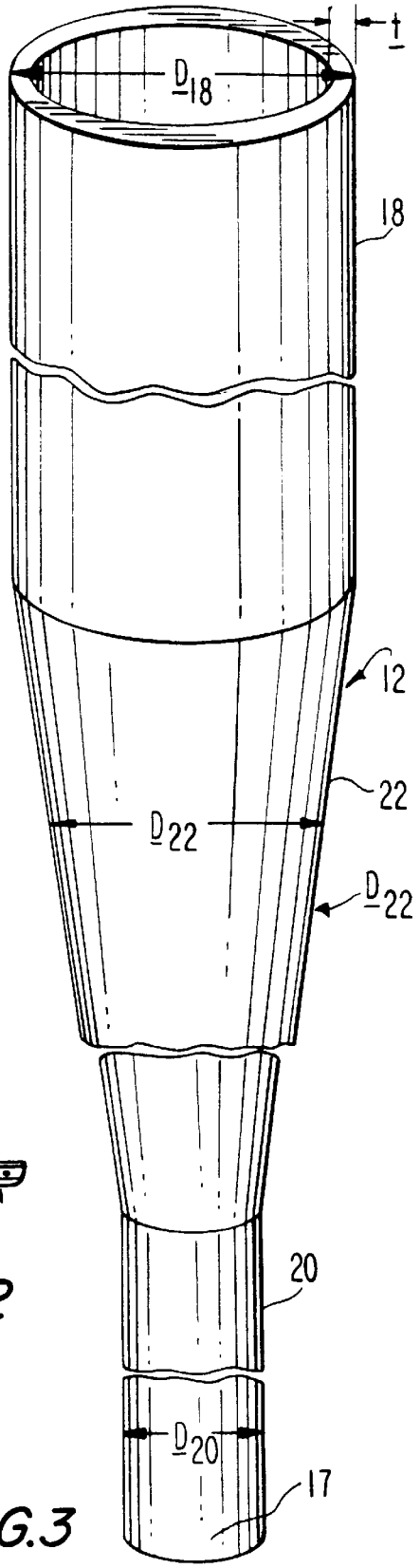
FIG. 3 is a fragmentary perspective view of the shaft of the golf putter illustrated in FIGS. 1 and 2.

In accordance with one aspect of the invention, the grip end length portion 18 has a substantially constant enlarged or oversized diameter $D_{18}$ (FIG. 3) of 1.2 inches. Thus, in accordance with the invention, the diameter $D_{18}$ of the grip end length portion 18 is substantially greater than the diameter of conventional putter shafts which are generally about 0.60 inches or about 50% of the diameter of the shaft of the embodiment of the invention described herein. It has been found that by enlarging the diameter of the grip end length portion of the putter, it is difficult, if not impossible, for a golfer to employ excessive wrist action in the putting stroke. Thus, as the diameter of the putter's grip end length portion is enlarged, and as the grip circumference in turn is enlarged, the golfer's hands are correspondingly more widely opened when he grips the club. A wider or more open grip "freezes" the golfer's wrists and physically prevents the golfer's left wrist from breaking down, if right hander or conversely the right wrist of a left handed golfer, during the putting stroke. Thus, an oversized diameter grip end length portion essentially requires that a firm-wristed stroke be made using the arms and shoulders, thereby ensuring that the putter face move will move through a wider arc close to the ground as desired. As discussed below, an enlarged diameter grip end length portion additionally results in a more relaxed and tension free grip which in turn improves the golfer's feel and putting touch. It should be noted that the grip end length portion or grip may have a cross-section other than circular, e.g., the shaft may have an ellipsoid cross-section or one that comprises a semi-circular segment with one flat outer side.

In any case, in accordance with the invention, the grip end length portion has a substantially constant enlarged transverse dimension, generally in the range of between about 1.0 to 1.75 inches. The maximum transverse dimension of the grip end length of the club in any direction, including the grip 23, may not exceed 1.75 inches according to applicable rules. The material from which the grip 23 is made is preferably thinner than conventional grip material which further improves the feel of the club. In the case where the diameter of the grip end length portion of the shaft is 1.75 inches, then the grip 23 is eliminated entirely.

In accordance with another aspect of the invention, while the grip end length portion 18 has enlarged diameter $D_{18}$, the hosel end length portion 20 has a substantially constant conventional diameter $D_{20}$ of about 0.7 inches, and the major center length portion 22 of the shaft has a tapered configuration characterized by a diameter $D_{22}$ (FIG. 3) which continuously and smoothly diminishes in size from the oversize diameter $D_{18}$ of the grip end length portion 18 to the diameter $D_{20}$ of the hosel end length portion. It is noted that the diameter $D_{20}$ of the hosel end length portion is enlarged relative to the hosel ends of conventional putter shafts. The tapered configuration of the major center length portion 22 of shaft 12 has the effect of optically foreshortening the total length of the putter shaft, i.e., making the putter shaft 12 appear to the golfer to be shorter than it really is. The golfer will therefore have a feeling of being closer to the ball than he or she actually is, which in turn increases the golfer's confidence, a factor considered to be as important as technique when putting. Moreover, the tapered configuration of the putter shaft contributes to enhanced transmission of the reaction force from the putter head to the golfer's hands through the shaft as discussed below.

The putter shaft 12 comprises a thin-walled tubular member formed of a filament wound or flag-wrapped composite material. In particular, the shaft is built up on a mandrel by wrapping at various angles pre-impregnated thin sheets of graphite filament embedded in epoxy resin onto the mandrel using a conventional sheet wrap or flag-rolled technique and then curing. Approximately three sheets are applied on the mandrel at any one cross-section with the bias of the graphite filaments in each sheet varying between 0° and 45°. The thickness t (FIG. 3) of the tubular wall of the putter shaft 12 manufactured in this matter is about 12 mils, and may generally be in the range of between 9 and 15 mils.

A putter incorporating a shaft constructed in this manner has excellent torsional rigidity, i.e., will have less of a tendency to twist upon contacting the ball, due to the high density and cross-biased filament winding or flag wrapping coupled with the oversized diameter of the shaft. At the same time, the shaft is extremely light weighing only about 100 grams compared to a weight of at least 125 grams of conventional putter shafts made of lightweight steel material. These features render the shaft itself advantageous for use in other golf clubs in addition to putters.

The reduced thickness of the tubular wall forming shaft 12, the enlarged diameter $D_{18}$ of the grip end length portion 18 and the tapered configuration of the major center length portion 22 together combine to provide the putter with a reaction force sensitivity or "feel" not available in conventional putters. The enlarged circumference of the grip end length portion 18 allows the golfer to grip the putter more loosely and in a more natural and relaxed way since the surface area of the grip is enlarged thus requiring less gripping force to reliably hold the club. A lighter grip enhances the sensitivity and feedback to the golfer's hands thereby enhancing the feel of the club. At the same time, the thinness and tapered configuration of the tubular wall forming shaft 12 enhances and amplifies the transmissibility of the reaction force along the shaft, and a substantially instantaneous feedback of the putt will be readily apparent to the golfer. Improved transmissibility is achieved due to the fact that the reaction force is not absorbed or dampened appreciably in view of the thin-wall construction of the shaft in view of the amplifying effect that the increasing diameter of the central shaft length portion has on the force transmission. The enlarged diameter of the grip end length portion and upper region of the major center length portion enables the tubular shaft wall to be thinner than might otherwise be possible while maintaining the high torsional rigidity of the shaft.

The present invention also comprises a new and improved cooperative interrelationship between a putter head and a putter shaft which provides simple and reliable alignment of the ball with the sweet spot of the ball-striking surface and which also insures that no twist is imparted to the ball when it is struck. Referring to FIGS. 4–7, the putter head 14, like all putter heads, includes a planar ball-striking surface 24 which in the illustrated embodiment has a loft of about 2°. The putter head 14 is connected to the end 17 of the hosel end length portion 20 of shaft 12 by means of hosel 16. The hosel 16 includes an elongate leg 26 that projects from a region 27 (FIG. 5) proximate to the heel of the putter inclined upwardly and directly forwardly in a vertical plane normal to the ball-striking surface 24. An elongate connecting portion 28 projects from the upper end of hosel leg 26 inclined upwardly and inwardly in a vertical plane substantially normal to the desired direction of ball travel. The hosel connecting portion 28 includes an inverted frusto-conical portion 30 from which a spigot 32 projects defining an upwardly facing shoulder 34 at the base of spigot 32. The spigot 32 is sized to snugly fit within the tubular end 17 of the hosel end length portion 20 of shaft 12 so that the shaft extends coaxially with hosel connecting portion 28. It is to be understood that the illustrated embodiment of the putter 10 is arranged for a right-handed golfer in that the shaft 12 extends at an incline from its connection to hosel 16 inwardly, i.e., toward the area where a right-handed golfer would stand. The shaft is secured to the hosel by adhesive and the spigot 32 is formed with circumferencial grooves 36 in which adhesive is received.

It is important when putting for the ball to be struck on the sweet spot of the ball-striking surface of the putter head. When the ball is struck by the sweet spot of the ball-striking surface, the putter head generally will not twist or deviate on contact from its orientation square or perpendicular to the direction of intended ball travel, and the ball will at least start off in the direction in which the face was aiming. According to the invention, the putter head and shaft are spacially situated relative to each other, and the shaft and hosel have a particular external configuration, such that a sighting surface is provided which, with the golfer properly positioned over the ball, will appear as a sighting edge which can be used to reliably align the ball with the sweet spot of the ball-striking surface. In particular, referring to FIGS. 6 and 7, the lower region 44 of the outwardly facing portion of frusto-conical portion 30 of hosel 16 constitutes a sighting surface which, with the golfer 46 positioned with his or her dominant eye vertically over the ball 36, will appear to the golfer as a curved edge. According to the invention, when the putter is positioned with the ball 36 is contiguous to the ball-striking surface 24 of the head, and the sighting edge/surface 44 of hosel 16 appears to the golfer to be tangential to the innermost point 46 of the hall's periphery, the ball will be aligned with the sweet spot 38 of the striking surface 24. Thus, in accordance with the invention, the cooperative spacial interrelationship between the putter head 14 and shaft 12 determined by the configuration of hosel 16, in cooperation with the external surface configuration of the hosel, provides means for accurately aligning the sweet spot of the putter's ball striking surface with the ball at the instant the ball is struck.

Figure 5:
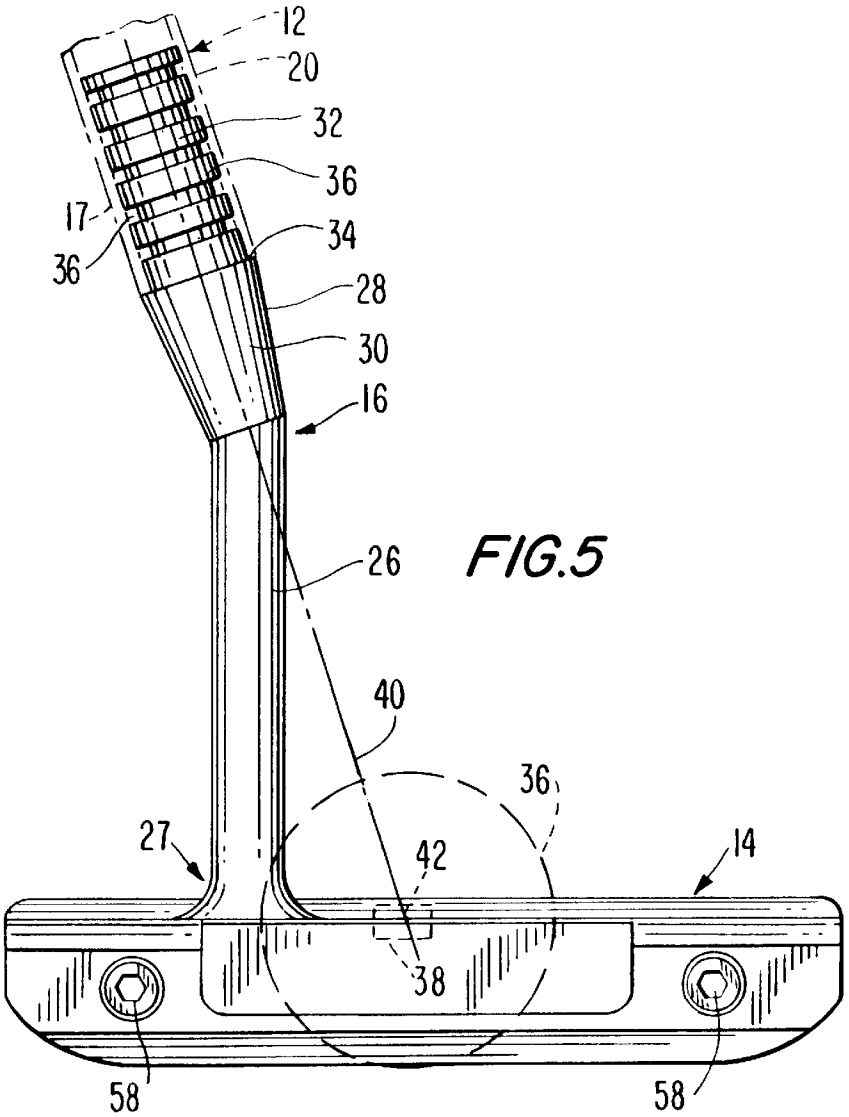
FIG. 5 is a rear view of the putter head and hosel illustrated in FIG. 4.
Figure 4:
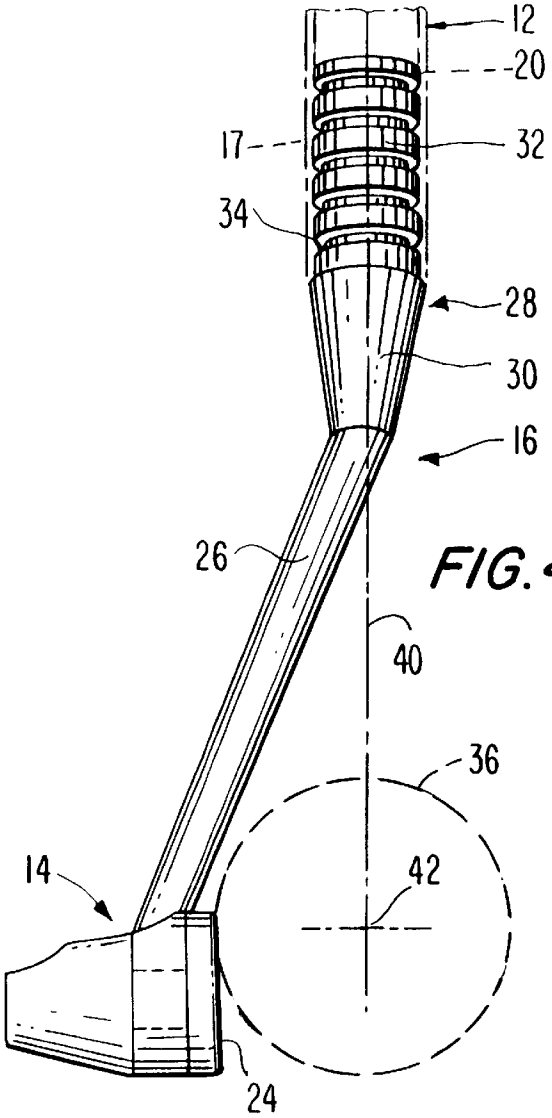
FIG. 4 is a side view of the putter head and hosel of the golf putter illustrated in FIGS. 1 and 2.

Referring to FIGS. 4 and 5, according to another feature of the invention, the hosel 16 is constructed to position the putter shaft 12 in relation to the head 14 such that the primary longitudinal axis 40 of the putter shaft 12 passes through the small central area 42 of the golf ball 36 at the instant the sweet spot 38 of the putter strikes the golf ball 36. In this manner, the torque or moment applied to the ball by the putter head lies only in a vertical plane and has no horizontal component. This results in a strictly vertical rotation of the golf ball as it leaves the putter head which is desirable from the standpoint of putting accuracy. Moreover, by providing that the shaft axis pass through the center of the golf ball, the ball-striking face of the putter head will tend to self-align itself when the ball is struck on the sweet spot to assume an orientation square to the desired direction of ball travel.

Figure 8:
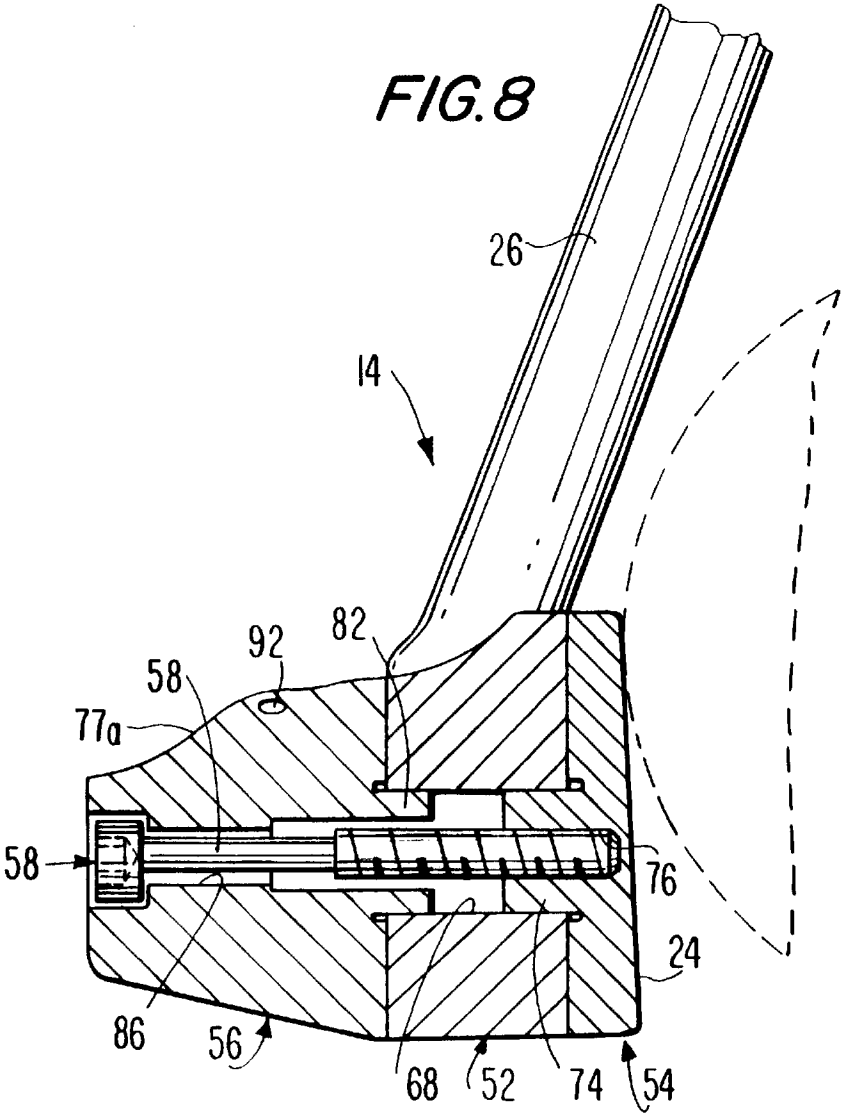
FIG. 8 is a section view of the putter head taken along line 8—8 of FIG. 6.
Figure 6:
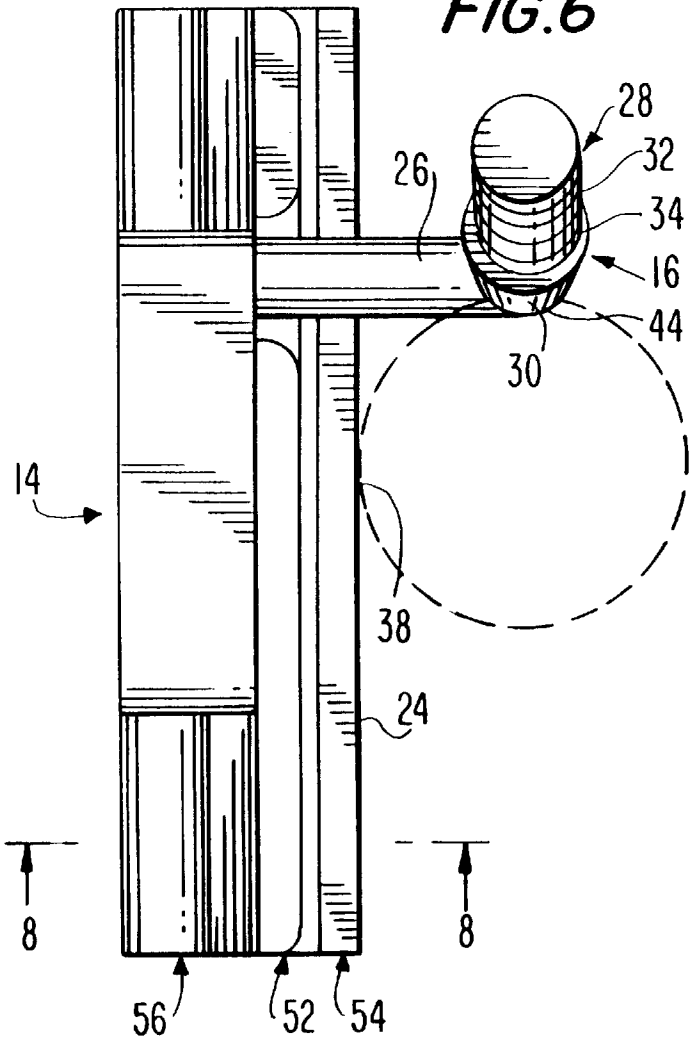
FIG. 6 is a top view of the putter head and hosel illustrated in FIGS. 4 and 5.
Figure 7:
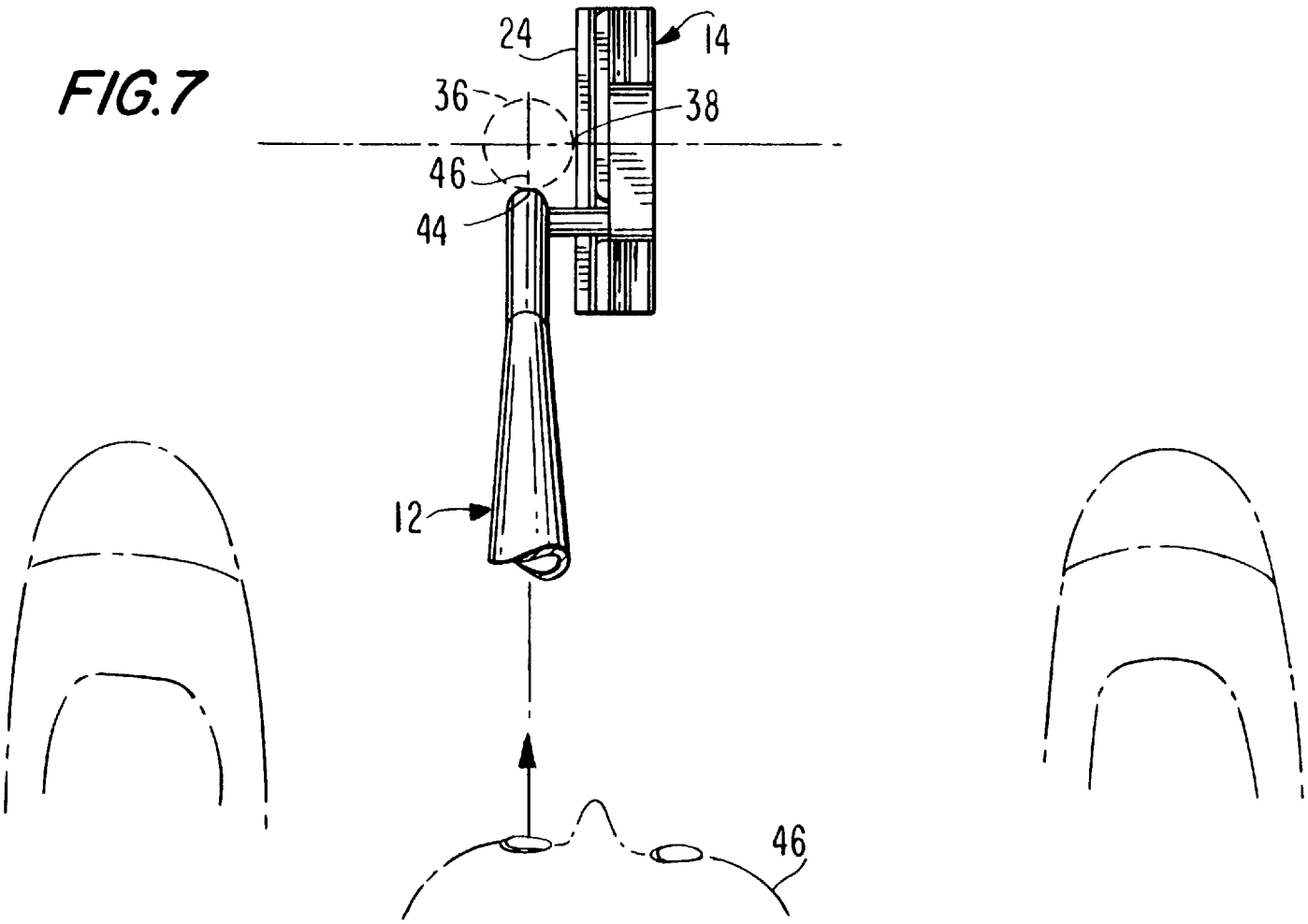
FIG. 7 is a view of a putter in accordance with the invention as seen by a golfer showing a golf ball properly aligned with the putter head.

The present invention also provides a new and improved construction of a putter head which may include a hosel integral therewith or attached thereto. Referring to FIGS. 4–6 and 8, a putter head 14 in accordance with the invention comprises a main frame 52 to which the elongate leg 26 of hosel 16 is attached, an interchangeable face plate 54 having the ball-striking surface 24, an interchangeable backweight member 56 and a pair of fastening members 58 for releasably interconnecting the main frame 52, face plate 54 and the backweight member 56 to each other to form a unitary assembly. As best seen in FIG. 8, the main frame 52 is clamped between the face plate 54 and the backweight member 56 by means of self retaining fastener members 58 that pass through an aperture 68 formed in the main frame 52.

Figure 9:
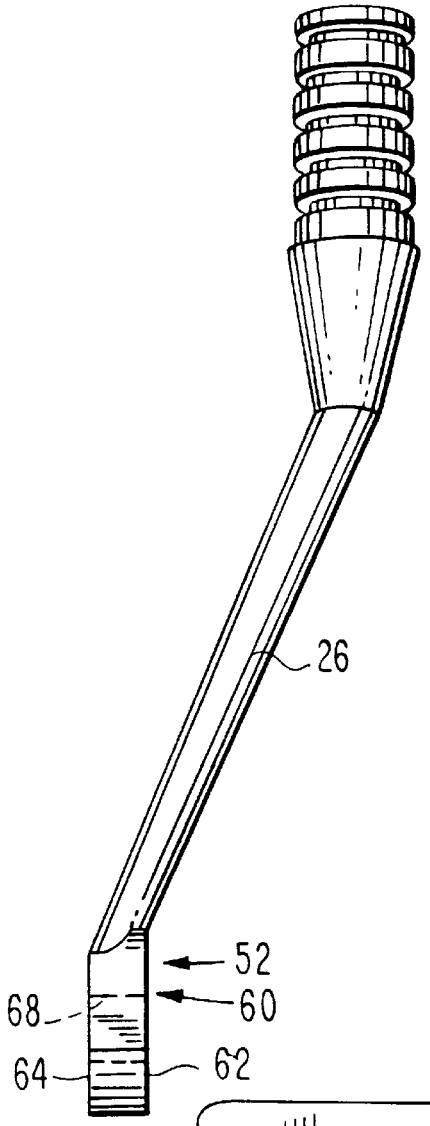
FIG. 9 is a side view of a main frame of a putter head in accordance with the invention.
Figure 10:
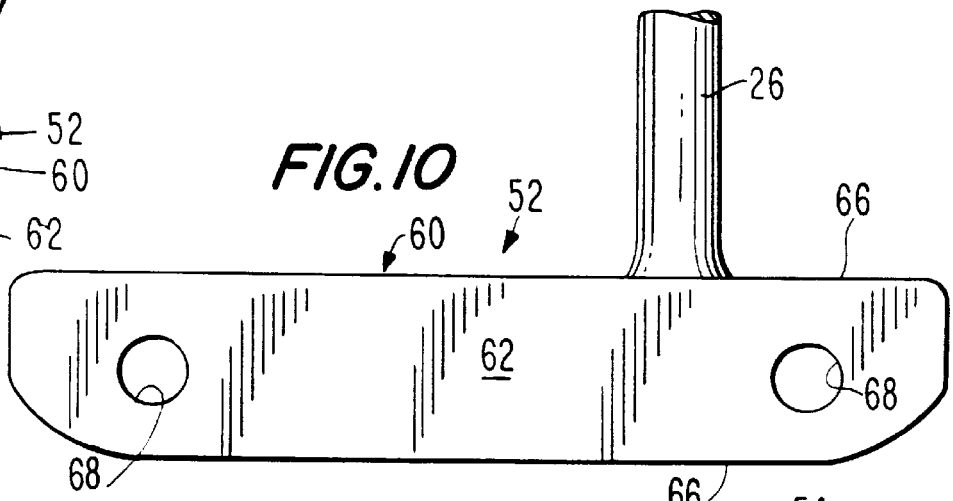
FIG. 10 is a front view of the putter head main frame of FIG. 9.

As seen in FIGS. 9 and 10, the main frame 52 has a body 60 having forward and rearward surfaces 62 and 64 and an outer periphery 66. The elongate leg 26 of hosel 16 is affixed to, such as by welding, and projects upwardly from the outer periphery 66 of main frame body 60 or may be formed integrally with the main frame body 60. A pair of bores 68 are formed through the body 60 of main frame 52.

Figure 12:
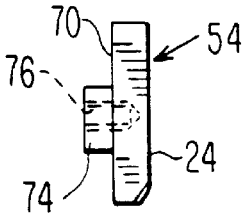
FIG. 12 is a side view of the putter head face plate of FIG. 11.
Figure 11:
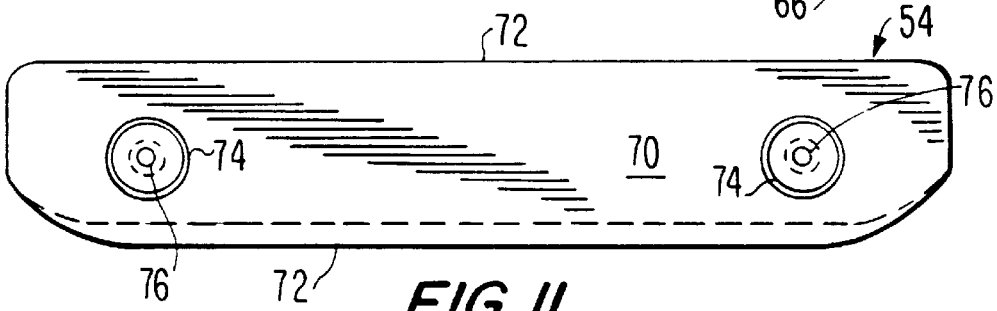
FIG. 11 is a rear view of a face plate of a putter head in accordance with the present invention.
Figure 14:
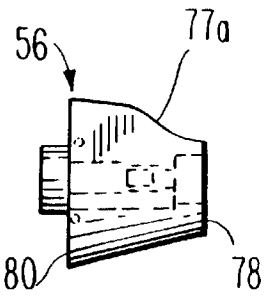
FIG. 14 is a side view of the putter head backweight member of FIG. 13.
Figure 13:
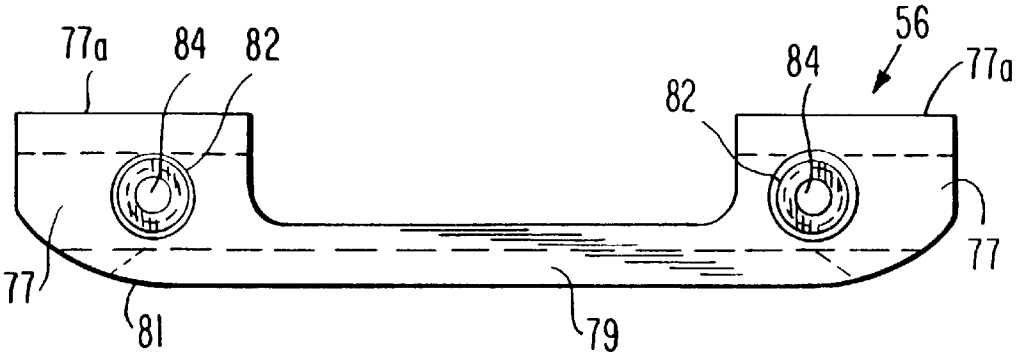
FIG. 13 is a front view of a backweight member of a putter head in accordance with the invention.
Figure 15:
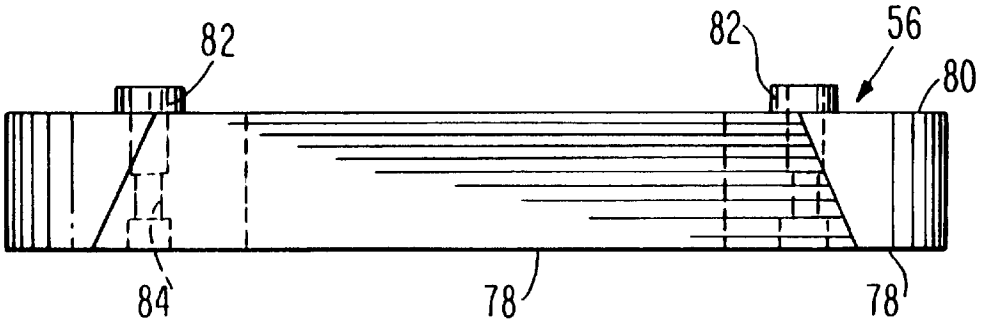
FIG. 15 is a bottom view of the putter head backweight member of FIG. 13.
Figure 16:
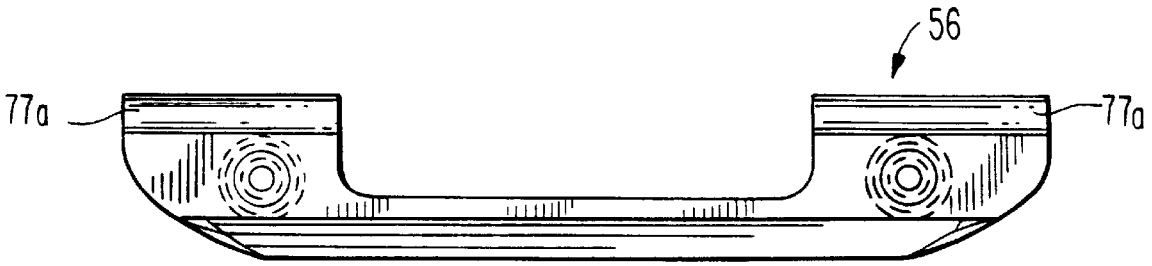
FIG. 16 is a rear view of the putter head backweight member of FIG. 13.

Face plate 54 (FIGS. 11 and 12) has the ball-striking forward surface 24, a rearward surface 70, and an outer periphery 72 that substantially matches the outer periphery 66 of main frame body 60. A pair of cylindrical bosses 74 extend from the rear surface 70 of face plate 54 and are structured and arranged to be received within corresponding bores 68 formed in main frame body 60 as seen in FIG. 8. An internally threaded blind bore 76 is formed in each of the bosses 74.

Referring to FIGS. 13–16 the backweight member 56 comprises a substantially U-shaped member having a reduced-height body portion 79 and a pair of upwardly projecting weight portions 77 at the ends of the body portion. The backweight member 56 has a rearward surface 78, a forward surface 80, and a periphery 81 that, except for the upper region intermediate of the weight portions 77, corresponds to the peripheries of the face plate 54 and main frame body 60. A pair of cylindrical bosses 82 extend from the front surface 80 of the backweight member and are structured and arranged to be received within corresponding bores 68 formed in the main frame body 60 as seen in FIG. 8. A stepped diameter through-bore 84 is formed through each of the bosses 82 opening onto the rearward surface 78 of the backweight member 56 at a countersunk region thereof.

Figure 17:
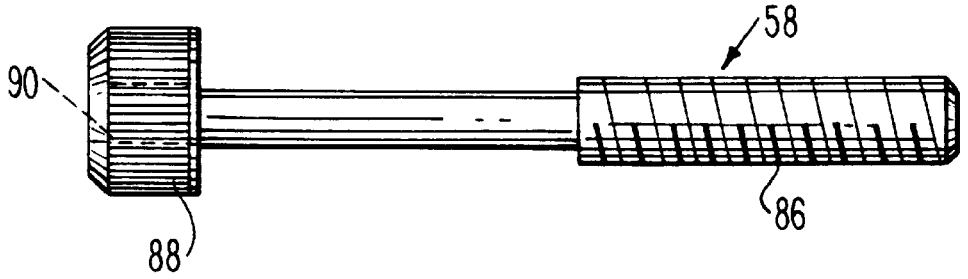
FIG. 17 is a side view of a fastener member for interconnecting the main frame, face plate and backweight member of a putter head in accordance with the present invention.

In assembly, the rear surface 70 of face plate 54 is positioned flush against the forward surface 62 of the main frame body 60 such that bosses 74 extend into the front of bores 68. Similarly, the forward surface 80 of backweight member 56 abuts flush against the rearward surface 64 of the main frame body 60 so that bosses 82 extend into the rear of bores 68. The bores 84 formed in backweight member 56 align with the threaded bores 76 formed in the face plate 54 as best seen in FIG. 8. Fasteners 58 (FIG. 17) having threaded forward ends 86 are inserted through the rear ends of bores 84 and the threaded forward ends of the fasteners 58 are threaded into the bores 76 in the face plate 54. The heads 88 of fasteners 58 are received and bear against the countersunk region of bores 84 so that as the fasteners 58 are tightened, such as by means of a socket wrench engaging sockets 90 in the heads 88 of fasteners 58, the face plate and backweight member are urged towards each other to clamp the intermediate main frame 52 between them and to form a unitary assembly.

A putter head constructed in accordance with the invention as described above provides several advantages. By virtue of its construction, both the face plate 54 and/or the backweight member 56 can be interchanged with other face plates and backweight members. For example, it may be desirable to replace the face plate of the putter with one having a different loft, i.e., the angle between the ball-striking surface 24 of the face plate 54 and the vertical. In longer grass greens, for example, a face plate providing for 2° of loft may be replaced by one providing 4° of loft. Depending upon conditions, a face plate made of titanium, or aluminum or stainless steel may be most effective. Similarly, a backweight member may be interchanged with another made of a different material. For example, a backweight member formed of brass may be replaced by one form of manganese bronze, titanium or aluminum.

Another important advantage provided by the putter head construction of the invention is that with the "floating" face plate construction of the type provided, i.e., where the face plate is suspended from the main frame without any peripheral support, the "feel" provided during the putting stroke is enhanced relative to a construction in which interchangeable face plates are surrounded by a frame when attached to the putter head. The backweight member is formed with a unique shape best seen in FIGS. 8 and 14. In particular, the upper surfaces 77*a* of the backweight member weight portions 77 are shaped to extend rearwardly for an initial distance with a gentle downward slope whereupon a steeper slope begins at about the mid region of each weight portion in the rearward direction. In this manner, the center of gravity 92 of the putter (FIG. 8) can be situated at an extreme rearward location, and about 80% of the weight of the putter head is behind the main frame 52. Indeed, it will be recognized that the total shape of the head can be varied and customized to suit any taste.

Obviously, numerous modifications and variations of the present invention are possible in the light of the above teachings. Therefore, it is possible in the light of the above specification to practice the invention otherwise than as specifically disclosed herein.

What is claimed is:

1. An improved golf putter for putting a golf ball along a path of desired golf ball travel and of the type having a hosel connecting a head to an elongated shaft, said elongated shaft comprising a first head end affixed to said putter head and a second grip end, a grip end length portion proximate to said grip end having a substantially constant enlarged transverse dimension between about 1.0 and 1.2 inches, a hosel end length portion proximate to said first head end having a substantially constant reduced transverse dimension between about 0.5 and 0.7 inches, and a tapered center length portion extending from said grip end length portion to said hosel end length portion having transverse dimensions which diminish in size from said enlarged transverse dimension at an end thereof proximate to said grip end length portion to said reduced transverse dimension at an opposite end thereof proximate to said hosel end length portion.

2. The golf putter according to claim 1, wherein the elongated shaft is a hollow elongated shaft having a wall thickness of between 9 and 15 mils.

3. The golf putter according to claim 1, wherein the center length portion has a length which is greater than a length of the hosel end length portion, and greater than a length of the grip end length portion.

4. An improved golf putter for putting a golf ball along a path of desired golf ball travel and of the type having a head connected to an elongated shaft, said elongated shaft comprising a first head end affixed to said putter head and a second grip end, a grip end length portion proximate to said grip end having a substantially constant enlarged transverse dimension between about 1.0 inches and 1.2 inches, an end length portion proximate to said first head end having a substantially constant reduced transverse dimension between about 0.5 and 0.7 inches, and a tapered center length portion extending from said grip end length portion to said end length portion having transverse dimensions which diminish in size from said enlarged transverse dimension at an end thereof proximate to said grip end length portion to said reduced transverse dimension at an opposite end thereof proximate to said end length portion.

5. The golf putter according to claim 4, wherein the center length portion has a length which is greater than a length of the end length portion, and greater than a length of the grip end length portion.

6. An improved golf putter golf putter for putting a golf ball along a path of desired golf ball travel and of the type having a hosel connecting a head to an elongated shaft, said elongated shaft comprising a first head end affixed to said putter head and a second grip end, a grip end length portion proximate to said grip end having a substantially constant oversized transverse dimension, a hosel end length portion proximate to said first head end having a substantially constant reduced transverse dimension, and a tapered center length portion extending from said grip end length portion to said hosel end length portion having transverse dimensions which diminish in size from said oversized transverse dimension at an end thereof proximate to said grip end length portion to said reduced transverse dimension at an opposite end thereof proximate to said hosel end length portion, said reduced transverse dimension being between 40% and 70% of the oversized transverse dimension.

7. The golf putter of claim 6, wherein the enlarged transverse dimension is about 1 inch.

8. The golf putter of claim 6, wherein the enlarged transverse dimension is about 1 inch.

9. The golf putter of claim 6, wherein the enlarged transverse dimension is substantially larger than 0.6 inches, but less than about 1.75 inches.

10. The golf putter according to claim 6, wherein the elongated shaft is a hollow elongated shaft having a wall thickness of between 9 and 15 mils.

11. The golf putter according to claim 6, wherein the center length portion has a length which is greater than a length of the hosel end length portion, and greater than a length of the grip end length portion.

12. An improved golf putter for putting a golf ball along a path of desired golf ball travel and of the type having a head connected to an elongated shaft, said elongated shaft comprising a first head end affixed to said putter head, a second grip end, a grip end length portion proximate to said grip end having a substantially constant enlarged transverse dimension, the substantially constant enlarged transverse dimension being substantially greater than 0.6 inches but no greater than 1.75 inches to reduce a likelyhood of excessive wrist action in the putting stroke;

an end length portion proximate to said first head end having a substantially constant reduced transverse dimension between about 0.5 and 0.7 inches, and a tapered center length portion extending from said grip end length portion to said end length portion having transverse dimensions which diminish in size from said enlarged transverse dimension at an end thereof proximate to said grip end length portion to said reduced transverse dimension at an opposite end thereof proximate to said end length portion.

13. The golf putter according to claim 12, wherein said reduced transverse dimension being between 40% and 70% of the enlarged transverse dimension to provide an optical forshortening effect.

14. The golf putter according to claim 12, wherein the elongated shaft is a hollow elongated shaft having a wall thickness of between 9 and 15 mils.

15. The golf putter according to claim 12, wherein the center length portion has a length which is greater than a length of the end length portion, and greater than a length of the grip end length portion.

* * * * *